United States Patent [19]

Woltron

[11] Patent Number: 4,568,415

[45] Date of Patent: Feb. 4, 1986

[54] METHOD OF PRODUCING STRINGS FOR BALL RACKETS, PARTICULARLY FOR TENNIS RACKETS, AND A STRING PRODUCED BY THIS METHOD

[75] Inventor: Herbert Woltron, Eisenstadt, Austria

[73] Assignee: Isosport Verbundbauteile GmbH, Eisenstadt, Austria

[21] Appl. No.: 574,104

[22] PCT Filed: May 13, 1983

[86] PCT No.: PCT/AT83/00014

§ 371 Date: Jan. 11, 1984

§ 102(e) Date: Jan. 11, 1984

[87] PCT Pub. No.: WO83/03998

PCT Pub. Date: Nov. 24, 1983

[30] Foreign Application Priority Data

Dec. 5, 1982 [AT] Austria ..... 1858/82

[51] Int. Cl.[4] ..... B65H 81/00

[52] U.S. Cl. ..... 156/185; 57/310; 156/190; 156/195; 156/229; 428/377

[58] Field of Search ..... 156/184, 185, 172, 195, 156/190, 162, 229; 428/373, 377; 57/260, 310, 242

[56] References Cited

U.S. PATENT DOCUMENTS

| | | | |
|---|---|---|---|
| 3,024,589 | 3/1962 | Vaughan | 156/172 X |
| 3,050,431 | 8/1962 | Crandall | 156/172 |
| 3,164,952 | 1/1965 | Neale et al. | 156/172 X |
| 4,168,603 | 9/1979 | Reich et al. | 57/310 |
| 4,168,606 | 9/1979 | Callander | 57/310 |
| 4,300,343 | 11/1981 | Nakamura et al. | 57/242 X |

*Primary Examiner*—David Simmons

*Attorney, Agent, or Firm*—Bierman, Peroff & Muserlian

[57] ABSTRACT

In the method for manufacturing strings, a plurality of narrow strip layers (22) of synthetic material are successively and coaxially helically wound on the cylindrical surface of a continuous core. The winding (3) thus produced is conveyed hot to a welding area (7) wherein the narrow strips (22) of synthetic material are mutually assembled by welding. The temperature of the welding area is adjusted high enough so that a welding between the narrow strips (22) takes place without substantially decreasing the breaking strength of the narrow strips (22) by such heat treatment. The appropriate materials for the narrow strips are olefines such as homopolymer polypropylene or terpolymer polypropylene-polyethylene-dienes. To reduce the tendency to flow, the material forming the narrow strips may contain a nucleation agent. The characteristics of the strings thus manufactured are similar to those of gut strings.

13 Claims, 4 Drawing Figures

METHOD OF PRODUCING STRINGS FOR BALL RACKETS, PARTICULARLY FOR TENNIS RACKETS, AND A STRING PRODUCED BY THIS METHOD

TECHNICAL FIELD

The invention relates to a method of producing a string for ball rackets, particularly for tennis rackets, wherein a plurality of winding layers of helically wound plastics sheet bands are applied to a continuously fed core, one over the other, along at least approximately concentric cylindrical surfaces, and the winding layers are joined to one another and to the core. The invention further relates to a string produced by the method according to the invention.

PRIOR ART

A method of the kind described above is known from U.S. Pat. No. 3,024,589. In this method a continuously fed nylon thread, serving as core, is for example impregnated with a liquid binder and then wound helically in two superimposed winding layers, wound in opposite directions, and the excess binder is stripped off. The resulting wet strand then passes through heated tubes, is thereby dried, and finally is drawn off and wound up as a finished string. According to modifications of the method additional pairs of winding layers may be applied to the wet strand, while however before each addition of a pair of winding layers the strand must be once again impregnated with the liquid binder. Instead of nylon threads, extruded bands may also be used as winding material.

The string known from the abovementioned U.S. Pat. No. 3,024,589 should have properties approximating to those of the customary gut strings used for stringing ball rackets. For the production of these gut strings the starting material is sheep or cattle gut, which is cut into narrow bands and subjected to treatment by chemical processes. A plurality of these narrow bands are then twisted together to form the strings. These gut strings now have the property that the dependence of their extension on the tensile force applied is substantially linear, that is to say the modulus of elasticity of the string material is substantially constant, and therefore is also not dependent on the prestress with which the string was fitted on the racket.

In FIG. 1 the curve A shows, for an ordinary commercially available gut string, the spring constant E.A. (in kN) defined by the product of the modulus of elasticity E and the cross-sectional area A of the string, plotted against the prestress $F_V$ (in N) of the string. As can be seen, the value of this spring constant E.A. varies only slightly with the prestress of the string. This gives rise to the good playing properties of tennis rackets strung with gut.

A disadvantage of stringing with gut consists on the one hand of the differences in quality which are unavoidable in manufacture and which are caused by fluctuations of the quality of the gut material used, and on the other hand of their high capacity to absorb moisture, which because of the consequent considerable variation of length, for example with high atmospheric humidity, impairs the playing properties of rackets strung with gut. In addition, the production of gut strings is relatively expensive.

For some years tennis rackets have now also been strung with strings of plastics materials. Ordinary commercially available plastics strings, which generally consist of a plastics monofilament, now have spring constant characteristics of a kind indicated, for example, by curve B in FIG. 1. In the applicable range of string prestress from 200 to 300 N, the spring constant E.A. is higher than that of comparable gut strings and in addition increases substantially linearly with a relatively steep gradient with increasing prestress. Consequently, the deformations of the strings which occur when the ball hits the racket are less than those occurring with comparable gut strings, and the force peaks which are required for braking a determined kinetic energy of the ball, and which have to be absorbed by the racket, are correspondingly higher than in the case of gut strings.

The player therefore feels that a racket strung with plastics strings is "hard" and that, in comparison with rackets strung with gut strings, it has a harder action, the more forcefully the strokes have to be made.

In comparison with a string made of a polyamide monofilament, a commerically available string of polyamide (nylon) of the type described in the previously mentioned U.S. Pat. No. 3,024,589 does not have an improved spring constant characteristic and, at least in respect of this aspect, does not come close to the properties of gut strings.

DESCRIPTION OF THE INVENTION

The object underlying the invention is that of indicating a method of producing strings for ball rackets, particularly for tennis rackets, in which a plurality of winding layers of helically wound plastics sheet bands are applied to a continuously fed core, one over the other, along at least approximately concentric cylindrical surfaces, and the winding layers are joined to one another, and which is less expensive than the known method mentioned in the prior art and leads to strings which have a similar flat spring tension characteristic to that of gut strings, while however it does not entail the disadvantages inherent in gut strings.

The object underlying the invention is achieved by the method according to the invention, wherein the plastics sheet bands used are of monoaxially stretched plastics materials, and wherein after the winding layers have been wound over the core the resulting wound assembly is passed, while under tensile stress, through a welding zone in which the plastics sheet bands are welded together at a raised temperature. The temperature in the welding zone is advantageously set at such a height that, although welding union takes place between the plastics sheet bands, this temperature treatment does not substantially reduce the breaking strength $\sigma_R$ of the monoaxially stretched plastics sheet bands used in the winding layers, advantageously ensuring that, if the string is at least substantially composed of plastics sheet bands of a uniform material, the temperature in the welding zone is so adjusted that the reduction of the breaking strength of the plastics sheet bands during the welding operation leads to a breaking strength of the finished strings which is not more than 20%, and advantageously not more than 15%, below the breaking strength of the plastics sheet bands used.

In an advantageous development of the method according to the invention the monoaxially stretched plastics sheet bands used consist of olefins of high molecular weight, which preferably contain polypropylene homopolymers or polypropylene-polyethylene copolymers.

According to another development of the method according to the invention, the monoaxially stretched plastics sheet bands used are composed of polypropylene-polyethylene-diene terpolymers.

In a further development of the method according to the invention the material of the plastics sheet bands used contains a nucleation agent, which may preferably be based on an organometallic complex compound.

Such nucleation agents increase the number of crystallites in the material of the bands, which, as the Applicants have found, reduces the tendency to creep of the monoaxially stretched sheet bands used.

According to a last advantageous development of the method of the invention, in preparation for the welding of the wound assembly the latter is preheated, in the course of its production, in one or more preheating devices, each interposed between two successive winding operations, while in at least a part of the preheating devices the partial wound assembly formed up to that point is advantageously superficially smoothed.

The invention further relates to the strings which are produced by the method according to the invention, and which have similar advantageous properties to those of gut strings.

BEST WAY OF APPLYING THE INVENTION

Figure 1:
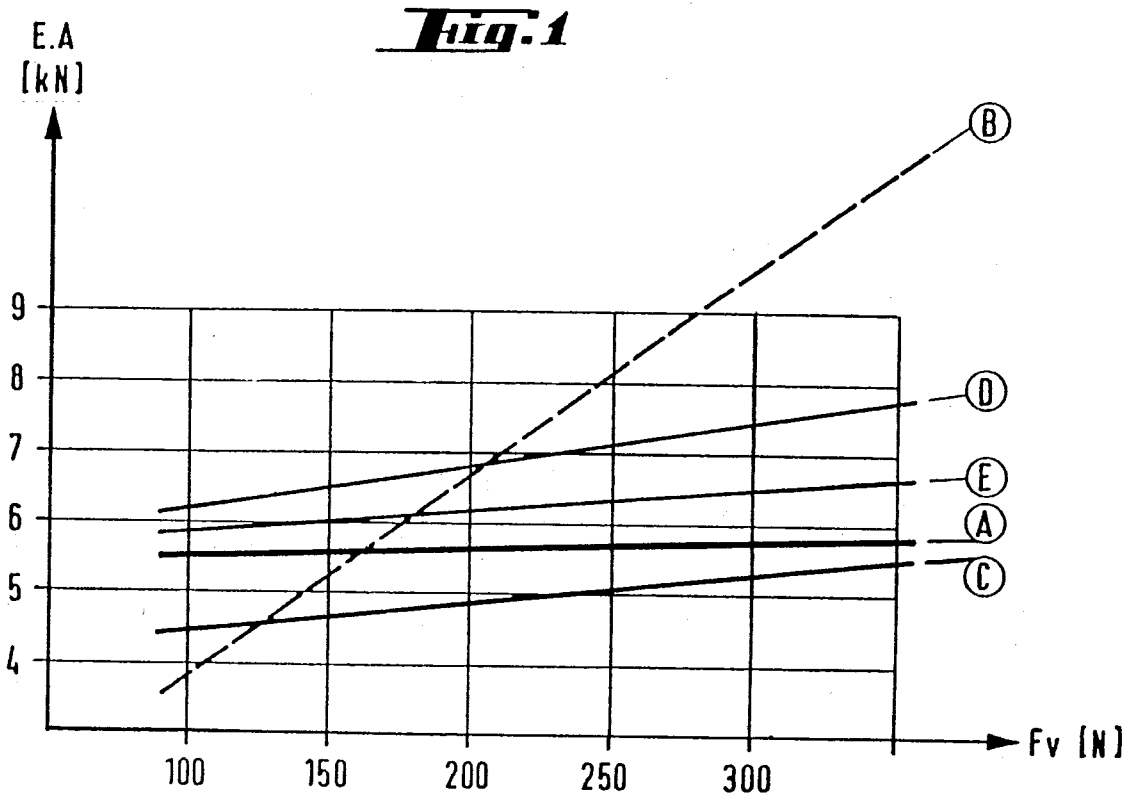
Figure 2:
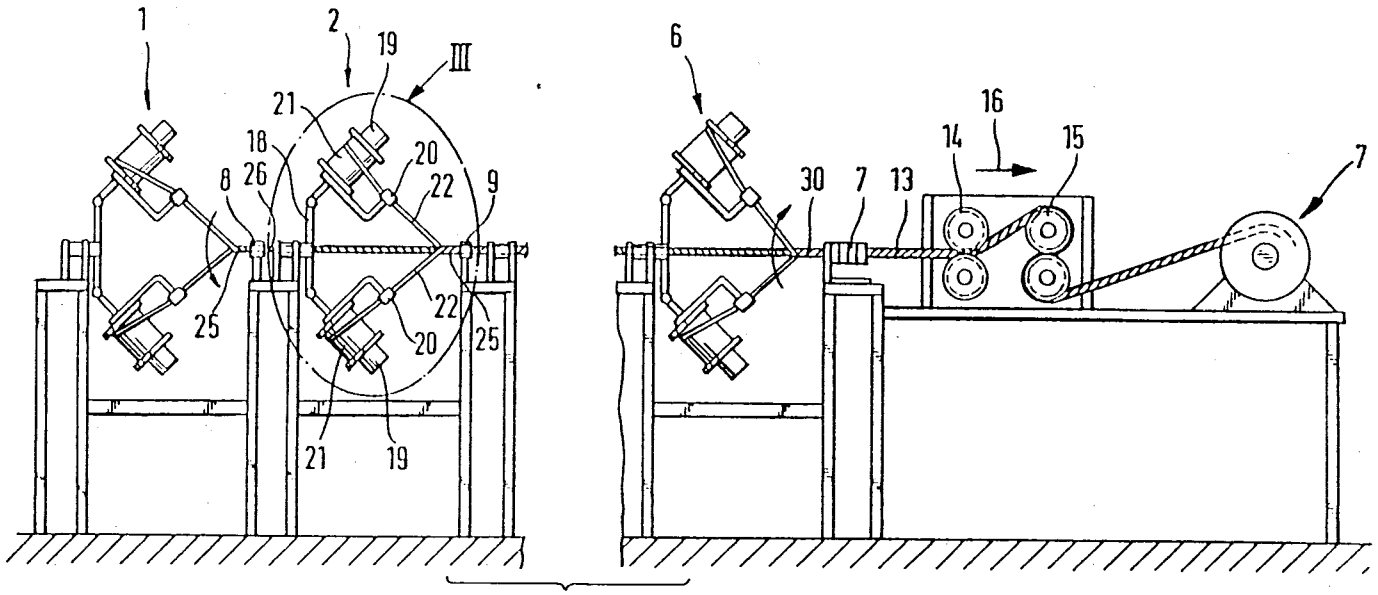
FIG. 2 shows schematically a preferred plant for producing the racket string. The plant comprises six serially disposed winders 1 to 6, which are substantially identical in construction and of which only the winders 1, 2 and 6 are shown in FIG. 2, a heated tubular welding apparatus 7, and five preheating nozzles 8 to 12, each disposed between two successive winders. The finished string 13, which is still hot, passes through a sizing apparatus 14 consisting of two grooved rollers, is drawn off by a draw-off apparatus 15 in the direction of the arrow 16, and finally is wound up at 17.

The method according to the invention for producing a racket string is first described below in greater detail with reference to one example. The manufacturing data, properties and spring stringing characteristics of this string and also those of five other racket strings produced by the method according to the invention can be seen in the Table at the end of the description or from FIG. 1.

In the example of embodiment which will be described ($C_1$ in the Table), bands 22 of a thickness of 35 μm and a width of 3 mm are used, which consist of a polypropylene-polyethylene-diene terpolymer extruded and then cold stretched with a stretching ratio of 1:6.5 in the lengthwise direction of the band. These bands 22 are wound onto spools 21, and the first four rotary stars 18, referring to the direction of advance 16, are each equipped with three spools 21 and the remaining two rotary stars 18 with two spools 21 each. This gives a winding sequence referred to below as 3/3/3/3/2/2. On commencement of production the bands 22 of each spool 21 are first guided through all the preheating nozzles 8 to 12 lying in the draw-off direction 16 and also through the welding apparatus 7, and are first drawn off together as a bundle by the draw-off apparatus 15 at a constant speed in the range between 1 and 2 meters per minute in the draw-off direction 16.

The drives of the rotary stars 18 and the heaters of the preheating nozzles 8 to 12 and also that of the welding apparatus 7 are then switched on. For the present production example the rotary stars of the winders 1, 3 and 5 are driven—viewing in each case in the opposite direction to the draw-off direction 16—in the clockwise direction and those of the winders 2, 4 and 6 are driven in the counterclockwise direction.

The racket string is thus formed in the following manner: in the first winder 1, to which no initial bundle is fed, one of the wound sheet bands 22 is given a twisted structure, over which the other two bands are applied are more or less uniform winding layers. The partial wound assembly 25 thus produced then passes through the first preheating nozzle 8, in which it is heated to a temperature at which welding of the sheet bands does not yet occur but at which the elasticity of the band material is increased, whereby the superficial smoothing of the partial wound assembly 25 effected in the preheating nozzle 8 is facilitated. The initial bundle 26 passing out of the first preheating nozzle now serves as a core for the winding layers consisting of sheet bands 22, which in the following winders 2 to 6 are wound helically and overlappingly along concentric cylindrical surfaces.

Figure 4:
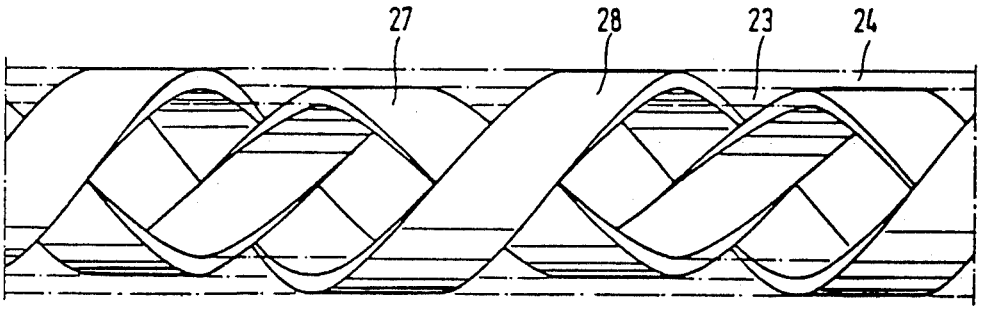
FIG. 4 shows schematically the winding process for each individual sheet band of the winding layers which constitute the two outermost layers 23 and 24 of the string. This Figure will be further explained with the aid of the following description of the application of the invention.

FIG. 4 shows the process of winding respective sheet bands 27 and 28 of winding layers which constitute the two outermost layers 23 and 24 of the string.

Figure 3:
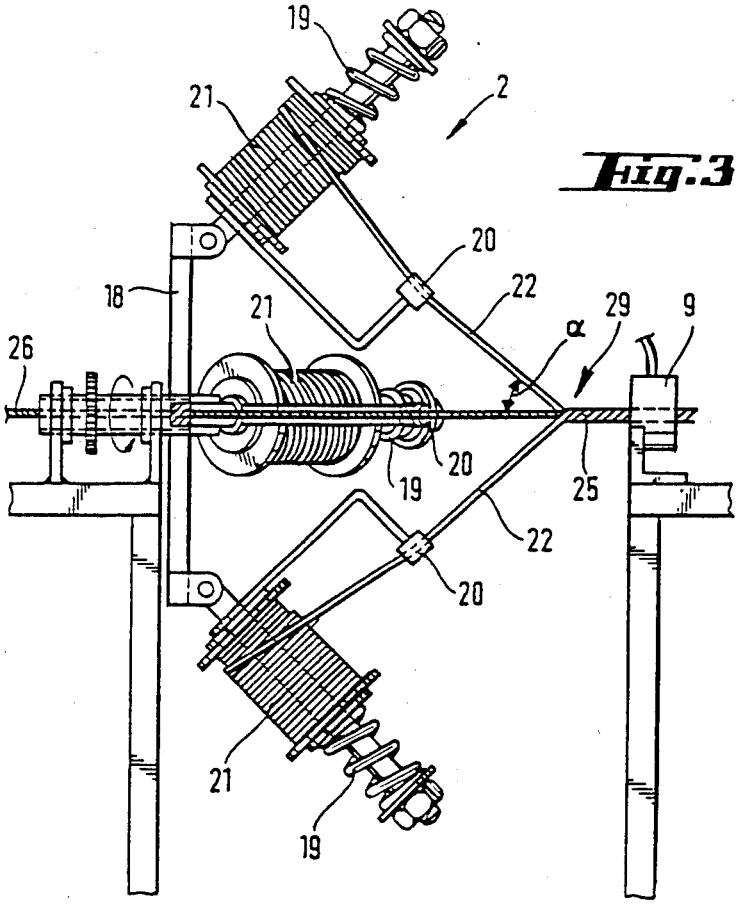
FIG. 3 shows the winder 2 followed by the preheating nozzle 9 on a larger scale and in greater detail. Each of the winders comprises a rotary star 18 having up to four pivotably mounted spools 21 provided with draw-off brakes 19 and with adjustable guide eyes 20, for the plastics sheet bands 22 used. Each rotary star 18 is equipped with a separate drive whose speed of rotation is continuously adjustable.

The pitch of the windings is determined by the draw-off speed, measured upstream of the welding apparatus 7, the speed of rotation of the rotary star 18, and the diameter of the respective initial bundle. It increases from one winding layer to the other from about 45° to 65°. The angle $\alpha$ (FIG. 3) at which the sheet band 22 advances to the winding point 29 adjusts itself in each case to a constant value; the position of the winding point 29 is determined by corresponding adjustment of the position of the guide eye 20. Since as a result of the action of the draw-off brakes 19 the sheet bands 22 are under tensile stress during the winding and because of the helical structure of the winding, a not inconsiderable contact pressure exists between the wound sheet bands 22 and the initial bundle 25 serving as winding core, which in the respective upstream preheating nozzle was brought to a temperature below the welding temperature and superficially smoothed. These initial bundles already form in each case compact winding structures containing no noteworthy air inclusions.

The wound assembly 30 running off from the last winder 6 then passes through the welding apparatus 7, in which a temperature in the range between 220° C. and 260° C. prevails. The already preheated wound assembly 30 is thereby brought to a temperature at which the sheet bands 22, which within this assembly lie flat against one another and, as explained above, are pressed against one another, are well welded together, but at which their anisotropy produced by the cold working of the sheet material is not substantially destroyed, which means that the breaking strength of the sheet bands used is not substantially reduced by this temperature treatment. In the present production example this brings about the result that the breaking strength of the finished string of 390N/mm$^2$, is lower than the breaking strength of the sheet bands used, which here amounts to 420N/mm$^2$.

The still warm string 13 running off from the welding apparatus 7 then passes through the sizing apparatus 14, in which in the present production example it is brought to a diameter of 1.20 mm, whereupon it is drawn off by the draw-off apparatus 15 in an already substantially cooled state and wound up at 17.

The finished string 13 has a spring constant characteristic as shown in curve C in FIG. 1. As can be seen, in the range of string prestress $F_v$ of 200 to 300N, which is here mainly employed in practice, the values of the spring constants E.A. are substantially lower and with increasing prestress $F_v$ rise substantially less sharply than in the case of comparable known plastics strings (curve B). The rise of the characteristic (curve C) is only slightly steeper than the rise of the characteristic of gut strings (curve A).

The data for five other production examples $C_2$, $C_3$, $D_1$, $D_2$, and E are tabulated in the Table at the end of the description.

In the production examples $C_2$, $C_3$, $D_1$, and $D_2$ the starting material is the same polypropylene-polyethylene-diene terpolymer sheet material as in the production example $C_1$ described in detail above, with a different stretching ratio of 1:6.5 (in the case of $C_1$, $C_2$ and $C_3$) and 1:8 (in the case of $D_1$ and $D_2$) applied to the sheet band used. In addition, as a variation from the other examples, in example $D_1$ only five winding layers are used instead of six. The polypropylene homopolymer used as sheet material in Example E contains about 1% of the nucleation agent of the type PP-78040 based on an organometallic complex compound, as supplied by Gabriel-Chemie, Vienna.

The strings according to production examples $C_2$ and $C_3$, like the string according to Example $C_1$, have a spring tension characteristic according to curve C in FIG. 1, the strings according to Examples $D_1$ and $D_2$ have a characteristic according to curve D, and the string according to Example E has the curve correspondingly designated E.

On the strength of the results obtained in the production examples it can be assumed that the spring tension characteristics of the racket strings produced by the method according to the invention are dependent substantially only on the sheet band material used and on its stretching ratio and only slightly or not at all dependent on the dimensions, the number and the winding sequence of the bands used.

INDUSTRIAL EXPLOITABILITY

The racket string produced by the method according to the invention can be employed with particular advantage for stringing tennis rackets. The properties of stringing of this kind are close to those of gut stringing. The manufacturing costs of the string according to the invention are however substantially lower than those of a corresponding gut string.

TABLE

| Racket Strings | | | | Sheet Bands Used | | | | |
|---|---|---|---|---|---|---|---|---|
| Example | Diameter in mm | Band winding sequence | Breaking strength $\sigma_R$ in N/mm$^2$ | Material | Thickness in $\mu$m | Width in mm | Stretching ratio | Breaking strength $\sigma_R$ in N/mm$^2$ |
| $C_1$ | 1.20 | 3/3/3/3/2/2 | 390 | | | | | |
| $C_2$ | 1.30 | 3/3/3/3/3/3 | 380 | PP-PE-diene ter-polymer | 35 | 3.0 | 1:6.5 | 420 |
| $C_3$ | 1.40 | 3/4/4/4/4/3 | 370 | | | | | |
| $D_1$ | 1.25 | 3/4/4/3/3 | 395 | | | | | |
| $D_2$ | 1.30 | 3/4/4/4/2/2 | 402 | | 30 | 2.8 | 1:8 | 464 |
| E | 1.25 | 3/3/3/3/2/2 | 420 | PP homo-polymer with nucle-ation agent | 35 | 2.5 | 1:8 | 457 |

What is claimed is:

1. Method of producing a string (13) for ball rackets, particularly for tennis rackets, wherein a plurality of winding layers of helically wound plastics sheet bands (22) are applied to a continuously fed core, one over the other, along at least approximately concentric cylindrical surfaces, and the winding layers are joined to one another, characterized in that the plastics sheet bands (22) used are made of plastic materials monoaxially stretched in the lengthwise direction of the band, and that after the winding layers have been wound over the core the resulting wound assembly (30) is passed, while under tensile stress, through a welding zone (7) in which the plastics sheet bands (22) are welded together at a raised temperature.

2. Method according to claim 1, characterised in that the temperature in the welding zone (7) is set at such a high level that, although a welding union is effected between the plastics sheet bands (22), the breaking strength of the monoaxially stretched plastics sheet bands (22) used in the winding layers are nevertheless not substantially reduced by this temperature treatment.

3. Method according to claim 2, characterised in that, in cases where the string (13) is at least to a substantial extent constructed of plastic sheet bands (22) of a uniform material, the temperature in the welding zone (7) is so adjusted that the breaking strength of the plastics sheet bands (22) is however not yet substantially reduced.

4. Method according to claim 2, characterised in that, in cases where the string (13) is at least to a substantial extent constructed of plastics sheet bands (22) of a uniform material, the temperature in the welding zone (7) is so adjusted that the reduction of the breaking strength of the plastics sheet bands (22) during the welding operation leads to a breaking strength of the finished string (13) which is not more than 20%, and advantageously not more than 15%, below the breaking strength of the plastics sheet bands (22) used.

5. Method according to one of claim 1 or 2, characterised in that the monoaxially stretched plastics sheet bands (22) used are based on olefins of high molecular weight.

6. Method according to claim 5, characterised in that the olefins of the band material contain polypropylene homopolymers.

7. Method according to claim 5, characterised in that the olefins of the band material contain polypropylene-polyethylene copolymers.

8. Method according to one of claim 1 or 2 characterised in that the monoaxially stretched plastics sheet bands (22) used are of polypropylene-polyethylene-diene terpolymers of high molecular weight.

9. Method of claim 1 or 2, characterised in that the material of the plastics sheet bands (22) used contains a nucleation agent.

10. Method according to claim 9 characterised in that the nucleation agent is based on an organometallic complex compound.

11. Method of claim 1 or 2, characterised in that in preparation for the welding of the wound assembly (30) the latter is preheated, during its manufacture, in one or more preheating devices (8–12), each of which is interposed between two successive winding operations.

12. Method according to claim 11, characterised in that, at least in a part of the preheating devices (8–12), the partial wound assembly (25) produced up to that point is superficially smoothed.

13. String (13) for ball rackets characterized in that it is produced by the method of claim 1.

* * * * *

UNITED STATES PATENT AND TRADEMARK OFFICE

CERTIFICATE OF CORRECTION

PATENT NO. : 4,568,415

DATED : Feb. 4, 1986

INVENTOR(S) : HERBERT WOLTRON

It is certified that error appears in the above-identified patent and that said Letters Patent is hereby corrected as shown below:

Title page:

[30] Foreign Application Priority Data

"Dec. 5, 1982" should be --May 12, 1982--

Signed and Sealed this

Seventh Day of April, 1987

*Attest:*

*Attesting Officer*

DONALD J. QUIGG

*Commissioner of Patents and Trademarks*